United States Patent [19]

Alonso

[11] Patent Number: 4,798,356

[45] Date of Patent: Jan. 17, 1989

[54] FLEXIBLE FRAME FASTENING SYSTEM FOR KITES

[75] Inventor: Frank Alonso, Pacoima, Calif.

[73] Assignee: Spectra Star Kites, Pacoima, Calif.

[21] Appl. No.: 86,263

[22] Filed: Aug. 17, 1987

[51] Int. Cl.[4] ..... B64C 31/06

[52] U.S. Cl. ..... 244/153 R; 135/36 R; 40/603

[58] Field of Search ..... 244/153 R; 135/36 R, 135/36 F, 36 RF; 40/603, 610, 612, 606

[56] References Cited

U.S. PATENT DOCUMENTS

| | | | |
|---|---|---|---|
| 2,459,928 | 1/1949 | Edwards | 40/610 |
| 2,484,096 | 10/1949 | Kay | 244/153 R |
| 2,863,263 | 12/1958 | Stein | 40/603 |
| 4,426,800 | 1/1984 | Brown | 244/153 R |

*Primary Examiner*—Galen Barefoot

*Attorney, Agent, or Firm*—Louis J. Bachand

[57] ABSTRACT

Kite frame rod anchoring structure for quick and effective mounting of kite frame rods to the kite sail comprising a tough, flexible web adhered to the kite sail and locally slit and free of sail securement to define a flexible pocket into which the frame rod ends are mounted.

11 Claims, 1 Drawing Sheet

FLEXIBLE FRAME FASTENING SYSTEM FOR KITES

TECHNICAL FIELD

This invention has to do with kite apparatus and more particularly with improved frame fastening systems for kites, and kites having such improved systems.

BACKGROUND

Kites comprise a frame of thin rods and a sail secured to the rods in a desired shape. A diamond shape kite is a typical example; a diamond shaped sail is secured to a cruciform of two rods. Control line is secured to the frame through openings in the sail for purposes of flying the kite. Ease of assembly for the consumer and security of the assembled relation of the kite parts against wind loads and inevitable crashes are of paramount importance.

Corner connection of the sail to the rod ends has been done by tying or somehow interlocking a string running the perimeter of the kite to the rod ends, but these modes are relatively costly to manufacture, inconvenient for the consumer, require undue skill in knot typing or are prone to separation upon collisions with the ground.

SUMMARY OF THE INVENTION

It is accordingly an object of the invention to provide an improved frame fastening system including a web structure for anchoring the frame rods to the kite sail. It is another object to provide such a structure in which the flexible pocketing of the frame rod ends precludes easy separation of the frame and sail under collision or severe wind stress conditions. A further object is to provide a frame fastening system which being soft and flexible moves supply with the kite sail to avoid tearing of the sail, and which has an extended area of attachment for firm securement, but nonetheless is simple to manufacture, simple to assemble onto the kite, low in cost and effective for its intended purpose.

These and other objects of the invention, to become apparent hereinafter, are realized by the provision of a low cost, flexible, frame anchoring structure for kites having a sail and a supporting frame of rods arranged for corner connection of their ends to the sail, the anchoring structure comprising a web secured to the sail and locally cut free to define a flexible pocket between the web and the sail for anchoring of the frame rod ends.

In this and like embodiments, the structure web is formed of thin, tough cellulosic or plastic material; the structure web is adhered to the sail in its portions surrounding the flexible pocket; the structure web has a U-shaped cut centrally therein to define a flap, the flap being free of securement to the sail and defining an entry beneath the web to the flexible pocket; and/or the structure web is secured to the sail circumferentially about the flexible pocket.

In another embodiment the invention provides a low cost, flexible, frame anchoring structure for kites having a sail and a supporting frame of rods arranged for corner connection of their ends to the sail, the anchoring structure comprising a web secured to both the face and obverse sides of the sail, the web having a central portion locally free of sail securement on the obverse side of the sail, and slit for entry of a frame rod end beneath the central portion in achoring relation.

In this and like embodiments, the the structure web is formed of thin, tough celulosic or plastic material; the structure web is adhered to the sail in its portions surrounding the flexible product; the structure web slit is U-shaped to define a flap free of securement to the sail obverse side below which the rod end passes into the flexible pocket; and the structure web is secured to the sail circumferentially about the flexible pocket.

The invention further provides a kite comprising intersecting frame rods and a sail, the sail being secured to the frame rods with a series of anchoring structures each comprising a flexible plastic or cellulosic web circumferentially adhered and centrally slit and free of securement to the sail to define a flexible pocket into which the rods are received and arranged on the sail to keep the frame rods in compression, the web being secured to the sail at its corners. The term "corner" herein refers to the anchoring point of the rod ends whether that point coincides with a break in the perimeter line around the kite sail or not.

THE DRAWING

The invention will be further described as to an illustrative embodiment in conjunction with the attached drawing in which.

PREFERRED MODES

Figure 1:
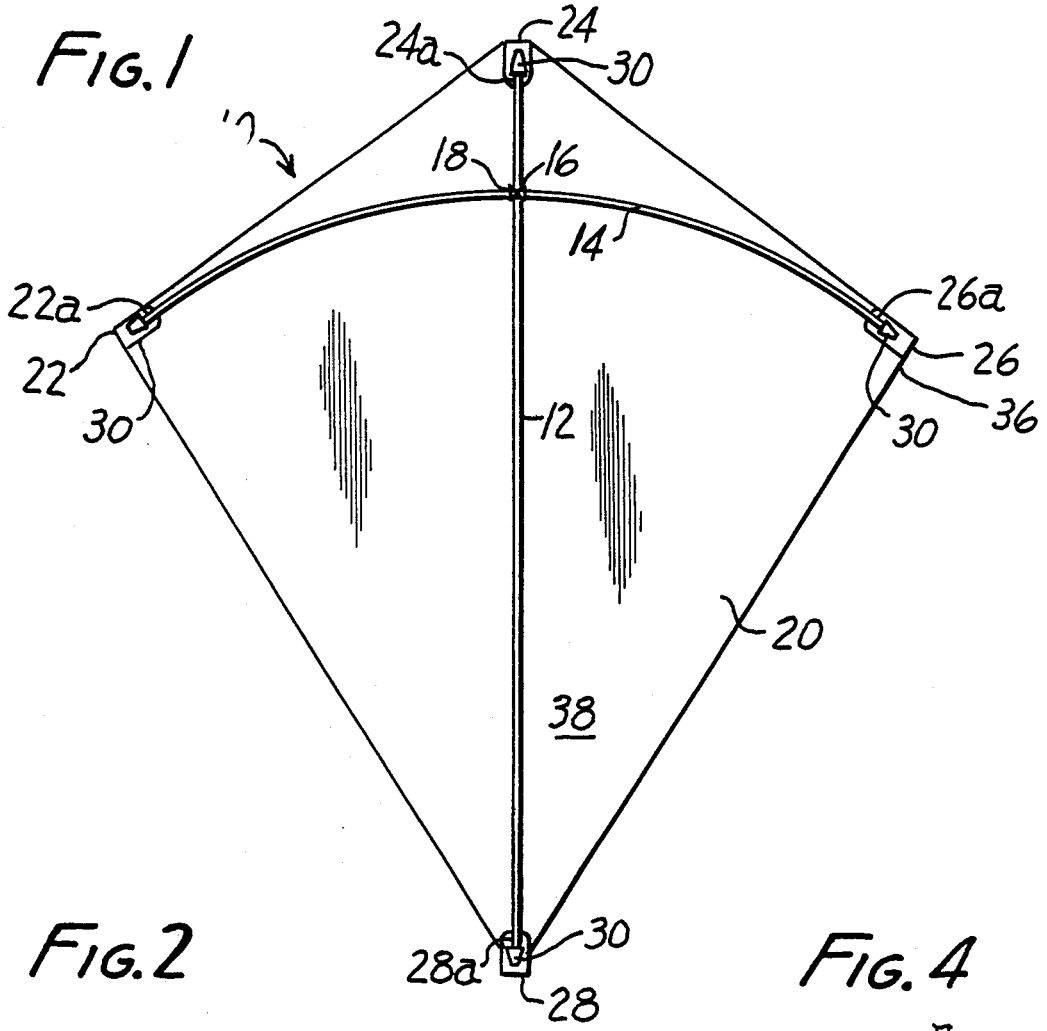
FIG. 1 is a bottom plan view of the assembled kite apparatus.

With reference to the drawing in detail, in FIG. 1 the kite 10 comprises a frame having a vertical rod 12 and a cross rod 14 which intersect at 16 where they are joined by a suitable fastener 18. The rods 12 and 14 are typically plastic rods, such as polypropylene. The kite sail is indicated at 20 and comprises a plastic or cellulosic sheet material suitably shaped, as in the diamond shape as shown, and to be distributively secured at its corners 22, 24, 26 and 28 to the frame rods 12, 14.

Figure 2:
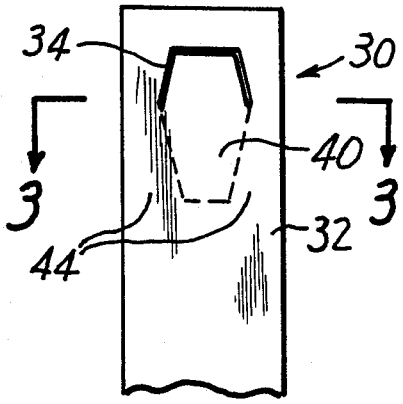
FIG. 2 is a detail view, greatly enlarged, of the frame rod anchoring structure.
Figure 3:
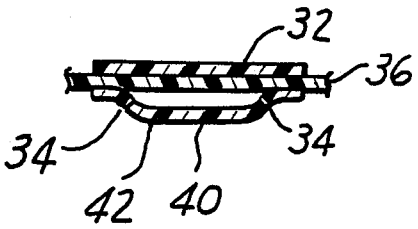
FIG. 3 is a view taken on line 3—3 in FIG. 2.
Figure 4:
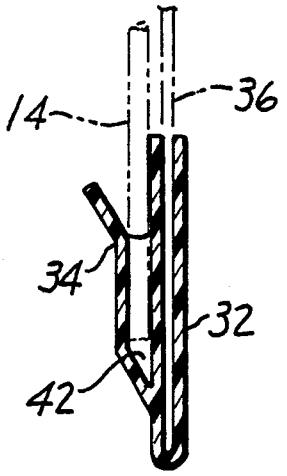
FIG. 4 is a view in vertical section of the installed structure.

At each of kite sail corners 22, 24, 26 and 28, for purposes of receiving the ends 22*a*, 24*a*, 26*a* and 28*a* of rods 12, 14, there is positioned a frame rod anchoring structure 30. The anchoring structure 30 is best shown in FIGS. 2–4 and comprises a soft, but tough, durable, flexible plastic or cellulosic web 32 typically cut from a larger piece of goods. For purposes of the invention, the web 32 is given a U-shaped cut 34 which as will be seen in the assembled condition of the anchoring structure provides a pocket 42 sized to readily receive an opposing kite frame rod end.

The web 32 is relatively elongated to be foldable medially so as to fold onto the kite sail edge margin 36 with the cut 34 bearing portion at the obverse of windward side 38 of the sail. The web 32 is adhered to the sail edge margin 36 by adhesive or heat seal means, or may be fastened in any suitable manner. Critical to the proper application of the web 32 is the omission of securement of the web to the sail in the central portion 40 of the web, having the cut 34 and theresurrounding.

The U-shaped cut 34 permits entry of the rod end, e.g. 22*a* into the pocket 42 formed by the cut and the central portion 40 of the web. Because of the soft. Flexible nature of the web 32 goods, the rod end 22*a* is snugly received, a relationship enhanced by the conical configuration of the pocket as it is closed by the sail-adhered portion 44 of the web 32 surrounding the pocket. The flexibility of the sail 20 further contributes to the pocketing of the rod end by the pocket 42, and further ensures its resisting ejection upon collision of the kite with the ground or severe wind conditions.

The supple nature of the web 32 and its obviously broad area of support permits high wind and shock loads to be absorbed without tearing of the attached sail. Unlike rigid connectors for mounting rod ends, in the present devices there is no sharp demarcation between web and sail which can act as a stress riser, to initiate and propagate failures.

The anchoring structures 30 are arranged around the periphery of the kite sail 20 in such manner that the frame rods inserted endwise therein are in compression so as to bow, in the case of of the cross rod 14, so as to obtain the requisite dihedral for good flying ability in the kite, or in the case of the vertical rod 12 to be difficult to dislodge while being easy to insert.

Manufacture of the kite 10 is facilitated by the use of the anchoring structures 30, since simple cutting of sheet goods is all that is required and adhering the cutouts to the sail in the desired locations.

The foregoing objects are thus met.

I claim:

1. Low cost, flexible, frame anchoring structure for kites having a sail and a supporting frame of rods arranged for corner connection of their ends to said sail, said anchoring structure comprising a web secured to said sail and locally cut free to define a flexible pocket between said web and said sail for anchoring of said frame rod ends, said structure web being secured to said sail circumferentially about said flexible pocket.

2. Corner structure according to claim 1, in which said structure web is formed of thin, tough cellulosic or plastic material.

3. Corner structure according to claim 1, in which said structure web is adhered to said sail in its portions surrounding said flexible pocket.

4. Corner structure according to claim 1, in which said structure web has a U-shaped cut centrally therein to define a flap, said flap being free of securement to said sail and defining an entry beneath said web to said flexible pocket.

5. In combination, a kite having a sail and a supporting rod frame, and the anchoring structure claimed in claim 1 arranged on said sail to keep said frame rods in compression.

6. Low cost, flexible, frame anchoring structure for kites having a sail and a supporting frame of rods arranged for corner connection of their ends to said sail, said anchoring structure comprising a web secured to both the face and obverse sides of said sail, said web having a central portion locally free of said securement on the obverse side of said sail, and slit for entry of a frame rod end beneath said central portion in achoring relation, said structure web being adhered to said sail in its portions surrounding said flexible pocket.

7. Corner structure according to claim 6, in which said structure web is formed of thin, tough celulosic or plastic material.

8. In combination, a kite having a sail and a supporting rod frame, and the anchoring structure claimed in claim 6 arranged on said sail to keep said frame rods in compression.

9. Corner structure according to claim 7, in which said structure web slit is U-shaped to define a flap free of securement to said sail obverse side below which said rod end passes into said flexible pocket.

10. Corner structure according to claim 9, in which said structure web is secured to said sail circumferentially about said flexible pocket.

11. Kite comprising intersecting frame rods and a sail, said sail being secured to said frame rods with a series of anchoring structures each comprising a flexible plastic or cellulosic web circumferentially adhered and centrally slit and free of securement to said sail to define a flexible pocket within said web circumference into which pocket said rods are received and arranged on said sail to keep said frame rods in compression, said web being secured to said sail at its corners.

* * * * *